US010906206B2

(12) United States Patent
Yun

(10) Patent No.: US 10,906,206 B2
(45) **Date of Patent: *Feb. 2, 2021**

(54) APPARATUS FOR MANUFACTURING FIBER-REINFORCED CONCRETE THROUGH SHOOTING AFTER INSERTING BUBBLES INTO NORMAL CONCRETE AND METHOD FOR MANUFACTURING SAME

(71) Applicant: KANGWON NATIONAL UNIVERSITY UNIVERSITY-INDUSTRY COOPERATION FOUNDATION, Gangwon-do (KR)

(72) Inventor: Kyong Ku Yun, Seoul (KR)

(73) Assignee: KANGWON NATIONAL UNIVERSITY UNIVERSITY-INDUSTRY CORPORATION FOUNDATION, Gangwon-do (KR)

( * ) Notice: Subject to any disclaimer, the term of this patent is extended or adjusted under 35 U.S.C. 154(b) by 443 days.

This patent is subject to a terminal disclaimer.

(21) Appl. No.: 15/126,194

(22) PCT Filed: Mar. 26, 2015

(86) PCT No.: PCT/KR2015/002958

§ 371 (c)(1),
(2) Date: Sep. 14, 2016

(87) PCT Pub. No.: WO2015/152567

PCT Pub. Date: Oct. 8, 2015

(65) Prior Publication Data

US 2017/0080599 A1 Mar. 23, 2017

(30) Foreign Application Priority Data

Mar. 31, 2014 (KR) ..... 10-2014-0037842
Mar. 25, 2015 (KR) ..... 10-2015-0041566

(51) Int. Cl.
*B28C 5/40* (2006.01)
*B28C 5/06* (2006.01)
*B28C 5/12* (2006.01)

(52) U.S. Cl.
CPC ..... *B28C 5/402* (2013.01); *B28C 5/06* (2013.01); *B28C 5/1269* (2013.01)

(58) Field of Classification Search
CPC .... B28C 5/00; B28C 5/02; B28C 5/08; B28C 5/40; B28C 5/42; B28C 5/142; B28C 5/148; B28C 5/1812; E01C 19/1027
See application file for complete search history.

(56) References Cited

U.S. PATENT DOCUMENTS 4,011,995 A * 3/1977 Krause, Jr. ..... E21B 41/0071 239/404
4,152,168 A * 5/1979 Yano ..... B28B 1/52 106/677

(Continued)

FOREIGN PATENT DOCUMENTS

EP 0 405 969 A1 * 1/1991
KR 10-2000-0055032 9/2000

(Continued)

OTHER PUBLICATIONS

International Search Report dated Jun. 29, 2015 for PCT/KR2015/002958.

*Primary Examiner* — Matthew J Daniels
*Assistant Examiner* — Mohammad M Ameen

(57) ABSTRACT

The present invention relates to an apparatus for manufacturing fiber-reinforced concrete through shooting after inserting bubbles into normal concrete and a method for manufacturing the same, which: form fiber-mixed concrete in which the bubbles, fiber-mixed materials, and silica fume are mixed in the normal concrete or form the fiber-mixed concrete in which aggregates, water, and the bubbles are put into and mixed with a mixture, in which cement, the fiber-mixed materials, and silica fume are mixed; and then shoots the fiber-reinforced concrete in which excessive air included in the fiber-mixed concrete is reduced by spraying (Continued)

the fiber-mixed concrete with the high-pressure air when the fiber-mixed concrete is discharged, and of which a slump, drastically increased due to the large amount of bubbles, is reduced to a range of the slump of the normal concrete, thereby improving the production capacity of the fiber-reinforced concrete and shortening operating time.

18 Claims, 10 Drawing Sheets

(56) References Cited

U.S. PATENT DOCUMENTS

| | | | | |
|---|---|---|---|---|
| 7,784,996 | B1 * | 8/2010 | Cummer | B28C 7/064 366/186 |
| 8,382,893 | B1 * | 2/2013 | Piazza | C04B 28/02 106/711 |
| 2007/0028808 | A1 * | 2/2007 | Cook | C04B 18/28 106/644 |
| 2009/0103392 | A1 * | 4/2009 | Bilger | B28C 5/468 366/4 |
| 2012/0100295 | A1 * | 4/2012 | Dubey | C04B 28/34 427/372.2 |
| 2012/0308797 | A1 * | 12/2012 | Mahan | C08K 9/02 428/220 |

FOREIGN PATENT DOCUMENTS

| | | | |
|---|---|---|---|
| KR | 10-2008-0034103 | | 4/2008 |
| KR | 10-2010-0068642 | | 6/2010 |
| KR | 10-2011-0096804 | | 8/2011 |
| KR | 10-2012-0001584 | * | 1/2012 |
| KR | 10-1246407 | | 3/2013 |

* cited by examiner

APPARATUS FOR MANUFACTURING FIBER-REINFORCED CONCRETE THROUGH SHOOTING AFTER INSERTING BUBBLES INTO NORMAL CONCRETE AND METHOD FOR MANUFACTURING SAME

This application claims the priority of Korean Patent Application Nos. 10-2014-0037842, and 10-2015-0041566, filed on Mar. 31, 2014, and Mar. 25, 2015 in the KIPO (Korean Intellectual Property Office), the disclosure of which is incorporated herein entirely by reference. Further, this application is the National Stage application of International Application No. PCT/KR2015/002958, filed Mar. 26, 2015, which designates the United States and was published in Korean. Each of these applications is hereby incorporated by reference in their entirety into the present application.

TECHNICAL FIELD

The present disclosure relates to an apparatus and method for manufacturing fiber-reinforced concrete, and more particularly, to an apparatus for manufacturing fiber-reinforced concrete through shooting after inserting bubbles into normal concrete and a method for manufacturing the same, in which a fiber-mixed concrete is formed by mixing bubbles, fiber-mixed material and silica fume into a normal concrete or a fiber-mixed concrete is formed by putting and mixing aggregates, water and bubbles into a mixture in which cement, fiber-mixed material and silica fume are mixed, and when the fiber-reinforced concrete is discharged, a high-pressure air is blown to reduce excessive air included in the fiber-reinforced concrete and simultaneously a slump of the fiber-reinforced concrete greatly increased due to a large amount of bubbles is decreased to a slump range of the normal concrete, so that this fiber-reinforced concrete is shoot, thereby improving the production capacity of the fiber-reinforced concrete and shortening operating time due to convenient construction.

BACKGROUND ART

A fiber-reinforced concrete is used for improving toughness, tensile strength, bending strength, crack resistance and impact resistance of concrete by uniformly dispersing discontinuous single fibers in the concrete. Generally, steel fiber, glass fiber, carbon fiber, basalt fiber, aramid fiber, polyethylene fiber, polyvinyl fiber, nylon fiber, cellulous fiber or the like are used, and it is known that the strength of the concrete is influenced by a fiber content rate, a fiber aspect ratio, a fiber coupling characteristic or the like.

The steel fiber means a steel wire having a short length and a small section with an aspect ratio (a ratio of length to a sectional size) of 30 to 100, which is arbitrarily dispersed in a concrete to reinforce the concrete. In addition, the steel fiber may be defined by strength and components of the fiber, or toughness, and may have a circular, oval, angular or crescent section depending on its preparation process or raw material. A content rate of the steel fiber put into a concrete is 0.05 to 2.0% (about 20 to 157 kg/m$^3$).

The synthetic fiber has chemical stability and excellent durability, and when being inserted into a concrete, the synthetic fiber gives various advantages by supplementing brittleness of the concrete, suppressing cracks caused by dry shrinkage, enhancing durability or the like. Representatively, the synthetic fiber may be polypropylene fiber. The polypropylene fiber is classified into a bundle type and a single yarn type. In the bundle type, fibers are formed in a net shape to be regularly distributed in a concrete, and thus when the fiber is put in a recommended amount (900 g/m$^3$), 6 millions/m$^3$ of fibers are distributed in the concrete. In case of the single yarn type, each fiber has a short shape, and when the fiber is put in a recommended amount (600 g/m$^3$), about 180 millions/m$^3$ of fibers are distributed in the concrete. A specific surface area of the single yarn type is about 10 times greater than that of the bundle type.

A fiber used for the fiber-reinforced concrete should meet the following requirements: excellent adhesion between fibers and a cement binder, excellent tensile strength of the fiber, an elastic modulus as much as ⅕ or above of the elastic modulus of the cement binder, an aspect ratio (L/D) of 50 or above, excellent durability, excellent heat resistance, excellent weather resistance, no problem in construction, inexpensive costs or the like.

The fiber-reinforced concrete has drawbacks such as fiber conglomeration (fiber ball) and uneasy putting and dispersion of fiber from a batcher plant at a construction site, and also the fiber is very expensive in comparison to cement concrete.

To solve the above problems, Korean unexamined patent publication No. 10-2008-0034103 discloses a repair method for deteriorated concrete using a uniform distribution system of fibers for cement mortar reinforcement.

In this document, a 'Y'-shaped injection ring is installed to a conveying pipe for conveying mortar in order to disperse fibers conveyed from a fiber dispersion tank, and a fiber content adjuster for adjusting an amount of put fibers and a straight injection ring for forming a swirl before the mortar mixed with fibers is finally discharged are installed to solve the above problems.

However, this technique has bad economic feasibility since construction costs are increased due to an increased number of components for fiber dispersion and a complicated inner configuration. In addition, even though fibers are supplied to mortar by means of the injection ring, mortar is not easily mixed with the fibers, which does not solve fiber conglomeration and also does not ensure uniform mixing of fibers, resulting in deterioration of quality.

DISCLOSURE OF THE INVENTION

Technical Problem

The present disclosure is designed to solve the above problems, and the present disclosure is directed to providing an apparatus for manufacturing fiber-reinforced concrete through shooting after inserting bubbles into normal concrete and a method for manufacturing the same, in which a fiber-mixed concrete is formed by mixing bubbles, fiber-mixed material and silica fume into a normal concrete or a fiber-mixed concrete is formed by putting and mixing aggregates, water and bubbles into a mixture in which cement, fiber-mixed material and silica fume are mixed, and when the fiber-reinforced concrete is discharged, a high-pressure air is blown to reduce excessive air included in the fiber-reinforced concrete and simultaneously a slump of the fiber-reinforced concrete greatly increased due to a large amount of bubbles is decreased to a slump range of the normal concrete, so that this fiber-reinforced concrete is shoot.

The present disclosure is also directed to providing an apparatus for manufacturing fiber-reinforced concrete through shooting after inserting bubbles into normal concrete and a method for manufacturing the same, in which a required amount of normal concrete is easily converted to a fiber-reinforced concrete at a construction site to enhance construction convenience and working efficiency and thus ensure excellent economic feasibility by shortening an operating time.

Technical Solution

In one general aspect, the present disclosure provides an apparatus for manufacturing a fiber-reinforced concrete through shooting after inserting bubbles into a normal concrete, the apparatus comprising:

a fiber-mixed concrete forming unit configured to form a fiber-mixed concrete by mixing bubbles, fiber-mixed material and silica fume into a normal concrete prepared by mixing water, cement, aggregates and so on at a predetermined ratio or by putting and mixing aggregates, water and bubbles into a mixture in which cement, fiber-mixed material and silica fume are mixed; and a concrete shooting unit configured to shoot a fiber-reinforced concrete whose slump is decreased to a slump range of the normal concrete, while dissipating bubbles included in the fiber-mixed concrete by blowing a high-pressure air of 5 atmospheres or above, when the fiber-mixed concrete mixed at the fiber-mixed concrete forming unit is discharged.

In another aspect, the present disclosure provides a method for manufacturing a fiber-reinforced concrete through shooting after inserting bubbles into a normal concrete, the method comprising:

forming, by a fiber-mixed concrete forming unit, a fiber-mixed concrete by mixing bubbles, fiber-mixed material and silica fume into a normal concrete prepared by mixing water, cement, aggregates and so on at a predetermined ratio or by putting and mixing aggregates, water and bubbles into a mixture in which cement, fiber-mixed material and silica fume are mixed; and shooting a fiber-reinforced concrete whose slump is decreased to a slump range of the normal concrete, while dissipating bubbles included in the fiber-mixed concrete by blowing a high-pressure air of 5 atmospheres or above, when the fiber-mixed concrete mixed at the fiber-mixed concrete forming unit is discharged.

Advantageous Effects

According to the present disclosure, a fiber-mixed concrete is formed by mixing bubbles, fiber-mixed material and silica fume into a normal concrete or a fiber-mixed concrete is formed by putting and mixing aggregates, water and bubbles into a mixture in which cement, fiber-mixed material and silica fume are mixed, and when the fiber-reinforced concrete is discharged, a high-pressure air is blown to reduce excessive air included in the fiber-reinforced concrete and simultaneously a slump of the fiber-reinforced concrete greatly increased due to a large amount of bubbles is decreased to a slump range of the normal concrete, so that this fiber-reinforced concrete is shoot, thereby improving the production capacity of the fiber-reinforced concrete and ensuring workability, waterproofing property, high strength and high durability.

In addition, according to the present disclosure, since a required amount of normal concrete is easily converted to a fiber-reinforced concrete at a construction site, it is possible to enhance construction convenience and working efficiency and thus ensure excellent economic feasibility by shortening an operating time.

DESCRIPTION OF REFERENCE NUMERALS

100: apparatus for manufacturing a fiber-reinforced concrete

110: bubble and fiber-mixed material putting unit

120: fiber-mixed concrete forming unit

130: concrete shooting unit

MODE FOR CARRYING OUT THE INVENTION

Figure 1:
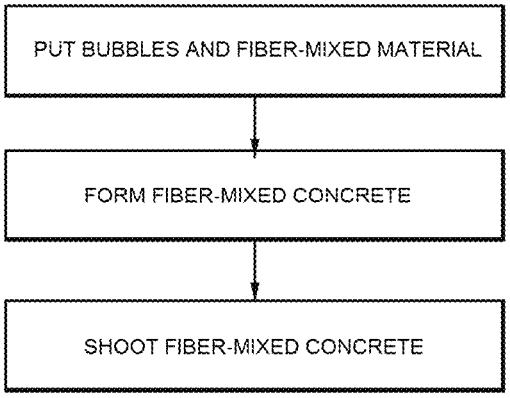
FIG. 1 is a flowchart of the present disclosure.
Figure 2:
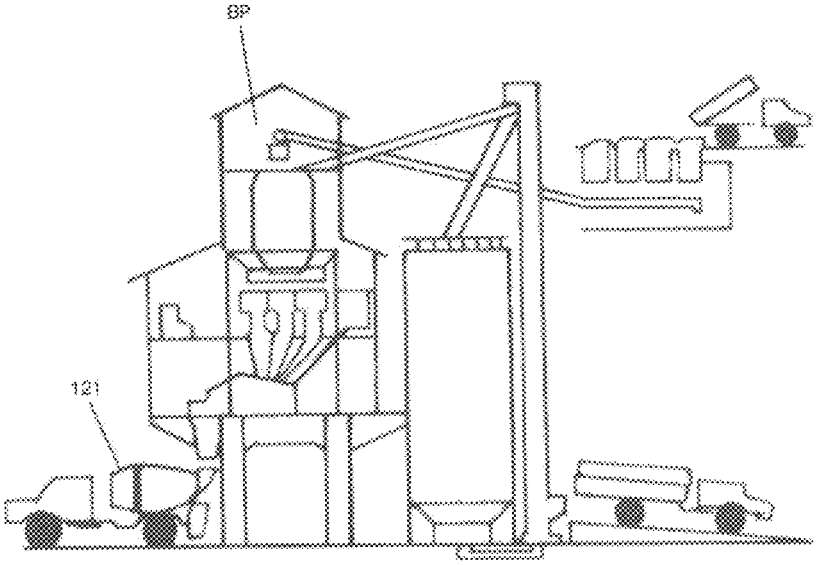
FIG. 2 is a diagram showing a normal concrete formed according to the present disclosure.

Hereinafter, the present disclosure will be described in detail with reference to accompanying drawings. FIG. 1 is a flowchart of the present disclosure.

An apparatus 100 for manufacturing a fiber-reinforced concrete through shooting after inserting bubbles into a normal concrete includes a fiber-mixed concrete forming unit 120 configured to form a fiber-mixed concrete by mixing bubbles, fiber-mixed material and silica fume into a normal concrete prepared by mixing water, cement, aggregates and so on at a predetermined ratio or by putting and mixing aggregates, water and bubbles into a mixture in which cement, fiber-mixed material and silica fume are mixed; and a concrete shooting unit 130 configured to shoot a fiber-reinforced concrete whose slump is decreased to a slump range of the normal concrete, while dissipating bubbles included in the fiber-mixed concrete by blowing a high-pressure air of 5 atmospheres or above, when the fiber-mixed concrete mixed at the fiber-mixed concrete forming unit 120 is discharged. This application will be described below in more detail.

The fiber-mixed material may be at least one selected from the group consisting of steel fiber, glass fiber, carbon fiber, basalt fiber, aramid fiber, polyethylene fiber, polyvinyl fiber, nylon fiber, cellulous fiber, and mixtures thereof.

The steel fiber, the glass fiber, the carbon fiber and the basalt fiber may be mixed by the content of 5 parts by weight, based on 100 parts by weight of cement of the normal concrete.

The aramid fiber, the polyethylene fiber, the polyvinyl fiber, the nylon fiber and the cellulous fiber may be mixed by the content of 3 parts by weight, based on 100 parts by weight of cement of the normal concrete.

The silica fume may be mixed by the content of 5 to 10 parts by weight, based on 100 parts by weight of cement of the normal concrete.

The fiber-mixed concrete forming unit 120 may include an external body 121 configured to accommodate the normal concrete together with the bubbles, the fiber-mixed material and the silica fume; a shaft 122 formed in the external body 121 to rotate by means of a power of a motor; and a mixing member 123 formed at the shaft 122 to have at least one stage in a radial direction to mix the normal concrete with the bubbles, the fiber-mixed material and the silica fume, thereby forming a fiber-mixed concrete.

The external body 121 may be a concrete mixer truck.

The fiber-mixed concrete forming unit 120' may include a hopper 124 configured to receive the normal concrete, a shaft 125 configured to rotate by a power of a motor provided at a lower end of the hopper 124, and a mixing member 126 mounted to the shaft 125 to mix the normal concrete with the bubbles, the fiber-mixed material and the silica fume, thereby forming a fiber-mixed concrete.

The concrete shooting unit 130 may include a shooting guide member 131 detachably mounted to the fiber-mixed concrete forming unit 120, 120' to compress and discharge a fiber-mixed concrete, and an air supply hole 132 formed through an outer circumference of the shooting guide member 131 to dissipate bubbles included in the fiber-mixed concrete and reduce an air volume by means of a high-pressure air of 5 atmospheres or above supplied therethrough.

The air supply hole 132 may be formed with a slope in a radial direction at the outer circumference of the shooting guide member 131.

Now, a construction process of the present disclosure configured as above will be described.

First, as shown in FIGS. 2 to 5, water, cement, aggregates and so on supplied from a batcher plant (BP) to a concrete mixer truck 121 are mixed and blended at a predetermined ratio to form a normal concrete with a slump of 80 mm or above, and then bubbles and fiber-mixed material put from a bubble and fiber-mixed material putting unit 110 are mixed with silica fume to form a fiber-mixed concrete. In another case, aggregates, water and the bubbles are put into a mixture prepared by putting cement, fiber-mixed material and silica fume into the concrete mixer truck 121 and mixing therein. At this time, cement, aggregates and water are put in a level of forming a normal concrete with a slump of 80 mm, and the put materials are mixed to form a fiber-mixed concrete at the fiber-mixed concrete forming unit 120, 120'.

Figure 6:
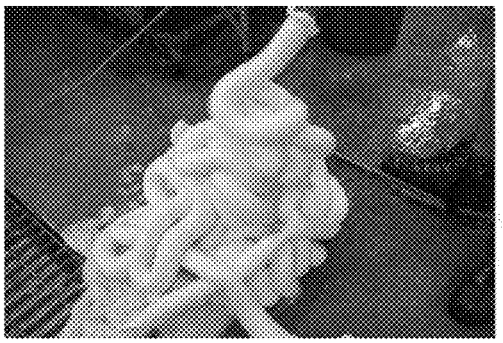
FIG. 6 is a diagram showing bubbles according to the present disclosure.

In other words, as shown in FIG. 6, the bubbles are generated by means of a foaming agent or a bubble generator. The foaming agent is an admixture for physically forming bubbles by means of surface activity by diluting with water in an amount of 30 to 50 times, and the foaming agent may obtain an air volume of up to about 80%. An amount of bubbles effective in the present disclosure may contain 20 to 40% of air in comparison to the entire fiber-reinforced concrete, and the bubbles may have a sphere-like shape with a size of 0.01 to 0.3 mm.

The fiber-mixed concrete enhances dispersion and pumping of the fiber-mixed material by means of a ball bearing effect of the bubbles. After shooting, 5 to 10 parts by weight of silica fume is mixed with 100 parts by weight of cement of the fiber-reinforced concrete while an air volume is maintained to be 5% or below, thereby ensuring strength and durability by means of the silica fume. Also, a fine aggregates proportion is set to be 70% in consideration of reduction of a rebounding amount, thereby ensuring economic feasibility.

Here, standards of the fiber-reinforced concrete in which the fiber-mixed material is mixed with silica fume are shown in Table 1 below, and an optimal mix foundation of the fiber-reinforced concrete is shown in Table 2 below.

TABLE 1

| Evaluation item | Unit | Development objective | Expected trouble | Alternative review |
|---|---|---|---|---|
| slump | mm | 100 or above | excessive slump drop | put bubbles put to ensure a suitable slump |
| air volume (fresh) | % | 25 to 30 | air volume drop | put bubbles put to ensure a suitable slump |
| air volume (hardened) | % | 3 to 6 | air volume drop | place shotcrete to decrease an air volume |
| steel fiber content rate | % | 2 to 5 | occurrence of fiber ball | put bubbles put to ensure dispersion |
| compressive strength (28 days aged) | MPa | 40 or above | strength development | use silica fume to ensure a compressive strength |
| flexural toughness (28 days aged) | MPa | 5.0 or above | strength development | use steel fiber to ensure flexural toughness |

TABLE 2

| | Gmax | Slump | W/C | S/a | unit weight (kg/m$^3$) | | | | | plasticizer | AEA |
|---|---|---|---|---|---|---|---|---|---|---|---|
| | mm | mm | (%) | (%) | W | C | S | G | SF | (%) | (%) |
| Standard mixing | 10 | 100 or above | 40 | 70 | 184 | 427.8 | 1.233 | 523 | 32.2 | 0.3 | 0.03 |

In addition, the fiber-mixed material may be at least one selected from the group consisting of steel fiber, glass fiber, carbon fiber, basalt fiber, aramid fiber, polyethylene fiber, polyvinyl fiber, nylon fiber, cellulous fiber, and mixtures thereof. Here, the steel fiber, the glass fiber, the carbon fiber and the basalt fiber may be mixed by the content of 5 parts by weight, based on 100 parts by weight of cement of the normal concrete. In addition, the aramid fiber, the polyethylene fiber, the polyvinyl fiber, the nylon fiber and the cellulous fiber may be mixed by the content of 3 parts by weight, based on 100 parts by weight of cement of the normal concrete. Also, the silica fume may be mixed by the content of 5 to 10 parts by weight, based on 100 parts by weight of cement of the normal concrete. If the fiber-mixed material and the silica fume are included smaller than the above range, ductility, impact resistance, high strength and high durability are deteriorated. If the fiber-mixed material and the silica fume are included greater than the above range, construction costs increase without enhancing ductility, impact resistance, high strength and high durability further.

Among the fiber-mixed material, the steel fiber employs a general hook-type steel fiber and serves as a concrete reinforcing material, prepared by processing a steel wire with a length of 30 to 60 mm and a diameter of 0.5 to 1.0 mm. Since the steel fiber may greatly enhance flexural toughness and resistance against cracks, the steel fiber is used for improving and reinforcing mechanical behavior characteristics and physical properties of concrete.

Figure 7:
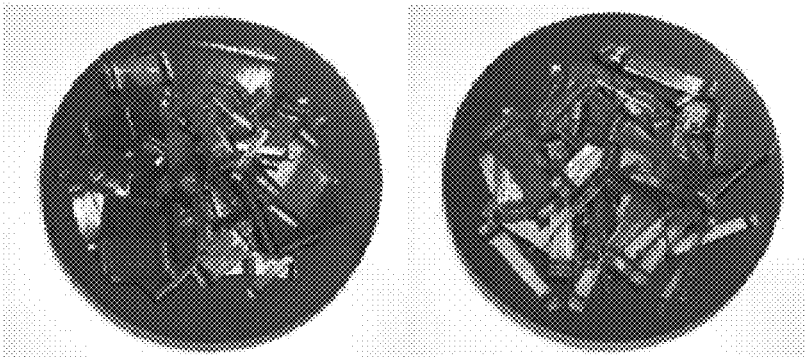
FIG. 7 is a diagram showing a steel fiber applied to the present disclosure.

In the present disclosure, steel fiber produced by a domestic company H is used. In the experiment, steel fiber (30 mm) for shotcrete and steel fiber (60 mm) for concrete, which are most frequently used at construction sites, are selected. FIG. 7 shows 30 mm steel fiber and 60 mm steel fiber used in the experiments, and Table 3 shows data of the steel fiber.

TABLE 3

| length (mm) | diameter (mm) | aspect ratio | specific weight |
|---|---|---|---|
| 30 | 0.5 | 60 | 7.85 |
| 60 | 0.75 | 80 | 7.85 |

Figure 3:
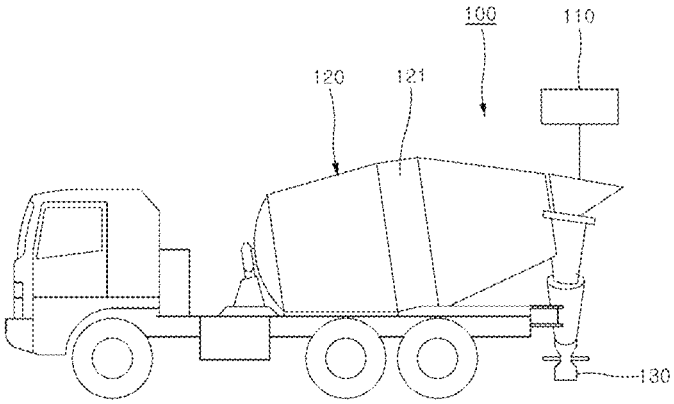
FIGS. 3 and 4 are diagrams showing a fiber-mixed concrete mixing unit according to the present disclosure.
Figure 4:
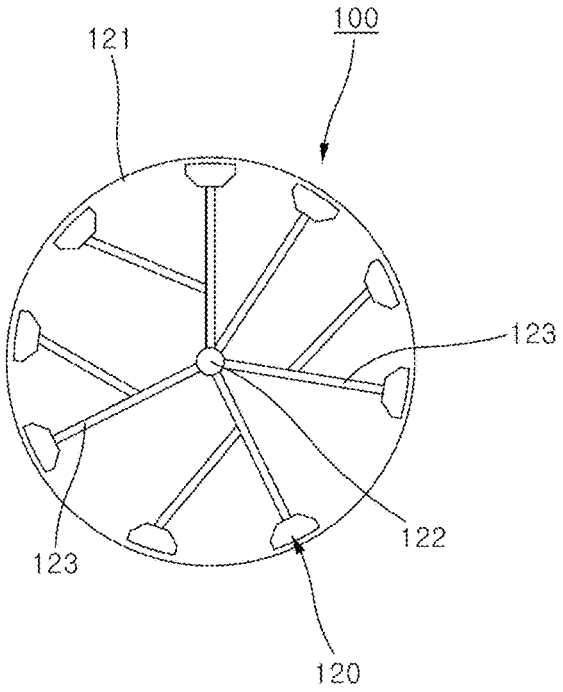

The fiber-mixed concrete forming unit 120, 120' forms a fiber-mixed material by mixing the normal concrete with bubbles, fiber-mixed material and silica fume or forms a fiber-mixed concrete by mixing cement with silica fume, water and bubbles. Here, as shown in FIGS. 3 and 4, in the fiber-mixed concrete forming unit 120, the shaft 122 rotates in the external body 121 by means of a power of a motor (not shown), and simultaneously the mixing member 123 formed at the shaft 122 to have at least one stage in a radial direction rotates to mix the normal concrete with bubbles, fiber-mixed material and silica fume, thereby forming a fiber-mixed concrete where fiber-mixed material and silica fume are dispersed well in the normal concrete by means of a ball bearing effect of the bubbles.

Here, the external body 121 may be a concrete mixer truck which receives and mixes cement, aggregates, water and so on, supplied from the batcher plant (BP).

Figure 5:
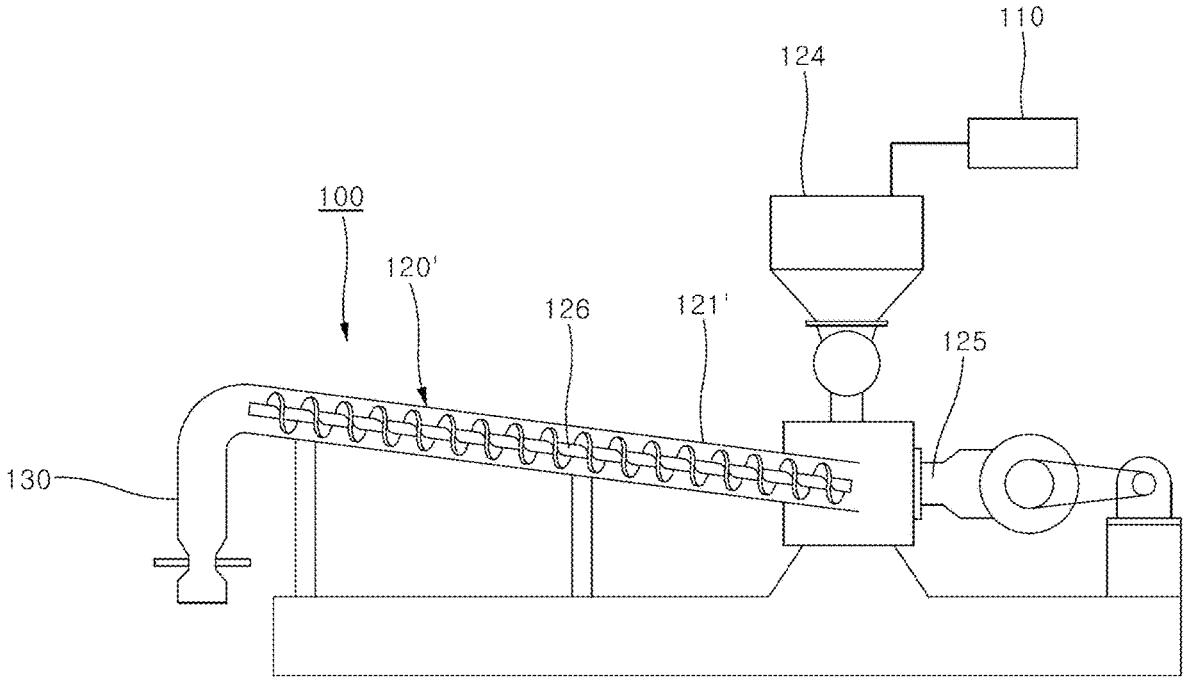
FIG. 5 is a diagram showing a fiber-mixed concrete mixing unit according to another embodiment of the present disclosure.

As shown in FIG. 5, if each material of the fiber-mixed concrete is supplied through a hopper 124 of the fiber-mixed concrete forming unit 120' to the external body 121', a mixing member 126 such as a screw mounted at the shaft 125 rotating by a power of a motor (not shown) rotates to move and mix such materials, thereby forming a fiber-mixed concrete.

Figure 8:
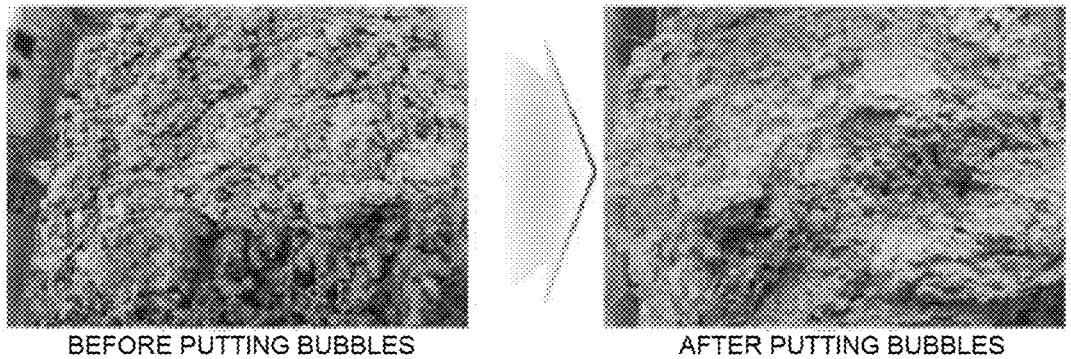
FIG. 8 is a diagram showing a mixed concrete before and after bubbles are put according to the present disclosure.

Here, the fiber-mixed concrete forming unit 120' is a vertical stirring mixer or a vertical stirring gravity mixer, which may block a bleeding phenomenon by rapidly putting bubbles into concrete or may have a slope so that its outlet is higher than the inlet and thus the bubbles and the concrete are uniformly mixed due to a difference in height. FIG. 8 shows a fiber-mixed concrete before and after bubbles are put.

In order to reduce a large amount of air included in the fiber-mixed concrete mixed at the fiber-mixed concrete forming unit 120, 120', an antifoaming agent is added to the fiber-mixed concrete, or the fiber-mixed concrete is shot by means of the concrete shooting unit 130. At this time, if the fiber-mixed concrete is shot by means of the concrete shooting unit 130, the fiber-mixed concrete formed at the fiber-mixed concrete forming unit 120, 120' is supplied to the inlet of the shooting guide member 131 of the concrete shooting unit 130, detachably mounted to the external body 121, 121'. However, since the inlet and outlet of the shooting guide member 131 have a greater diameter than the center portion, the fiber-mixed concrete supplied to the shooting guide member 131 is compressed to generate a pressure.

Figure 9:
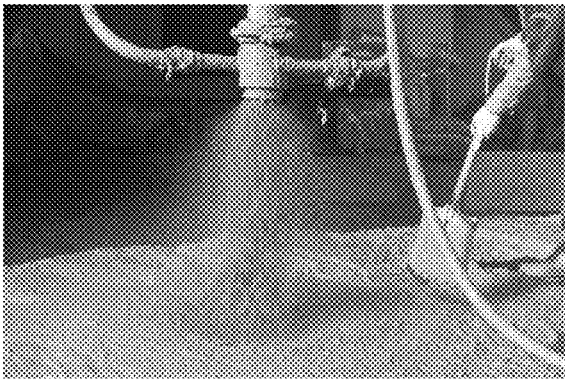
FIG. 9 is a diagram showing a fiber-reinforced concrete shot by a concrete shooting unit according to the present disclosure.
Figure 10:
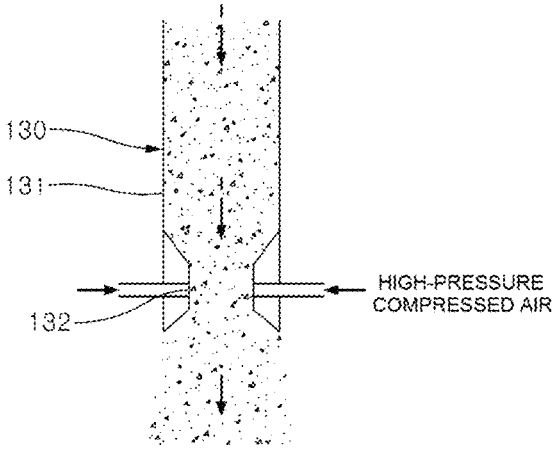
FIG. 10 is a schematic cross-sectional view of FIG. 9.
Figure 11:
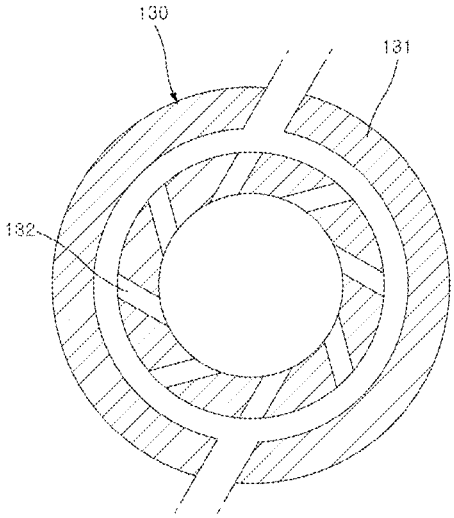
FIG. 11 is a schematic planar-sectional view of FIG. 9.

In addition, as shown in FIGS. 9 to 11, the fiber-mixed concrete passes through the outlet of the shooting guide member 131, which has a greater diameter than the center portion, via the center portion of the shooting guide member 131, and simultaneously a high-pressure compressed air of 5 atmospheres or above is supplied to the air supply hole 132 formed with a slope in a radial direction at the outer circumference of the shooting guide member 131 and is swirled and shot to the outlet of the shooting guide member 131. At this time, the compressed air and the fiber-mixed concrete are spread in a spraying manner, and when the compressed air and the fiber-mixed concrete are spread, the compressed air collides with the fiber-mixed concrete to dissipate a large amount of bubbles included in the fiber-mixed concrete.

Figure 12:
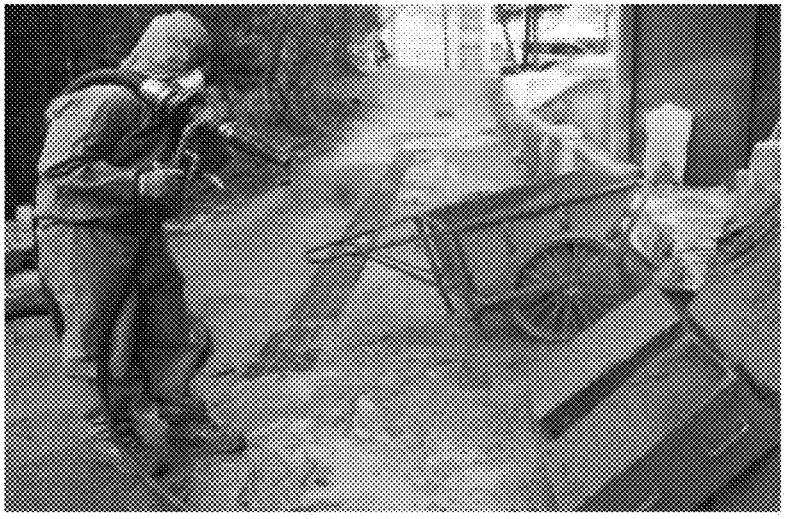
FIG. 12 is a diagram for illustrating a process of preparing a test panel using the fiber-reinforced concrete shot by the concrete shooting unit according to the present disclosure.
Figure 13:
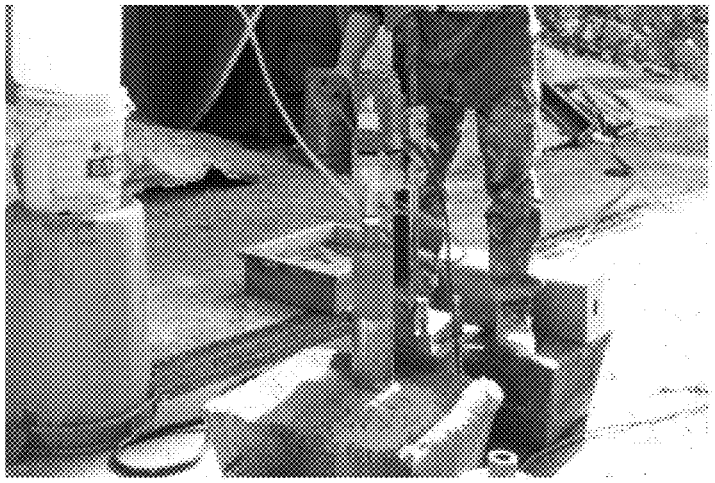
FIGS. 13 and 14 are diagrams for illustrating a process of collecting and cutting a core of the panel prepared in FIG. 12.
Figure 14:
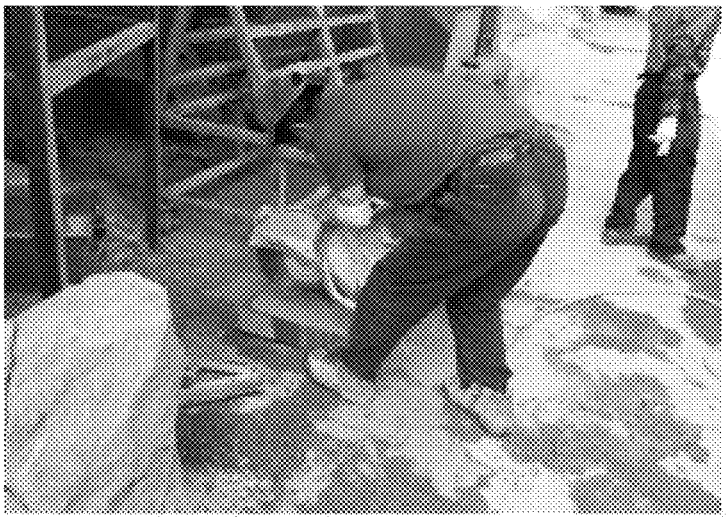

For the fiber-reinforced concrete shot to the shooting guide member 131, a test panel is prepared as shown in FIG. 12, and then a core of the made panel is collected and cut as shown in FIGS. 13 and 14.

A basic property and durability test of the panel prepared as above has been performed according to schedules and sample sizes as shown in Table 4, according to KS standards and ASTM standards. However, if there is no authorized standards, a suitable method has been devised during the study.

TABLE 4

| Test items | | Test schedule and mold sample size | | Measurement method | Amount |
|---|---|---|---|---|---|
| Characteristic before hardening | slump | before and after placing shotcrete | — | KS F 2402 | once each time |
| | air volume | before and after placing shotcrete | — | KS F 2421KS F 2429 | once |
| | dispersion evaluation | before and after placing shotcrete | Ø100*200 | checking by naked eyes and washing experiment KS F 2783 | twice |
| | measurement of unit quantity | before and after placing shotcrete | — | — | once each time |
| Strength characteristic | compressive strength | before and after placing shotcrete | collect Ø100*200 core (28, 56 days) | KS F 2405 | 6 |
| | flexural toughness | before and after placing shotcrete | cut 100*100*460 panel (28 days) | KS F 2566 | 3 |
| Durability characteristic | image analysis | before and after placing shotcrete | collect Ø100*200 core | ASTM C 457 | 1 |

Experiment Procedure (1) Slump Test

Figure 15:
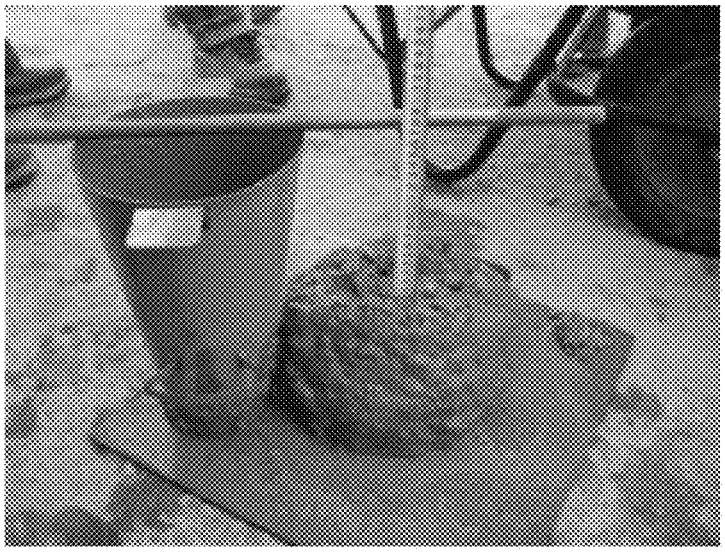
FIG. 15 is a diagram for illustrating a process of measuring a slump according to the present disclosure.

In order to determine watery of an unhardened fiber-mixed concrete paste, a slump test was performed according to KS F 2402 (a concrete slump test method). FIG. 15 shows that a slump is measured.

(2) Air Volume Test

Figure 16:
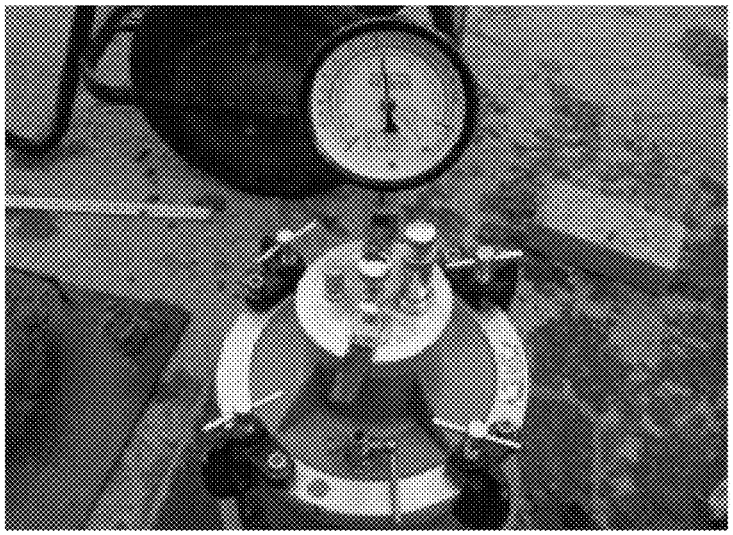
FIG. 16 is a diagram for illustrating a process of measuring an air volume according to the present disclosure.

An air volume test for an unhardened fiber-mixed concrete was performed according to KS F 2421 (an air volume test method by compressing unhardened concrete: an air chamber compressing method). FIG. 16 shows that an air volume is measured.

(3) Steel Fiber Dispersion Evaluation

Figure 17:
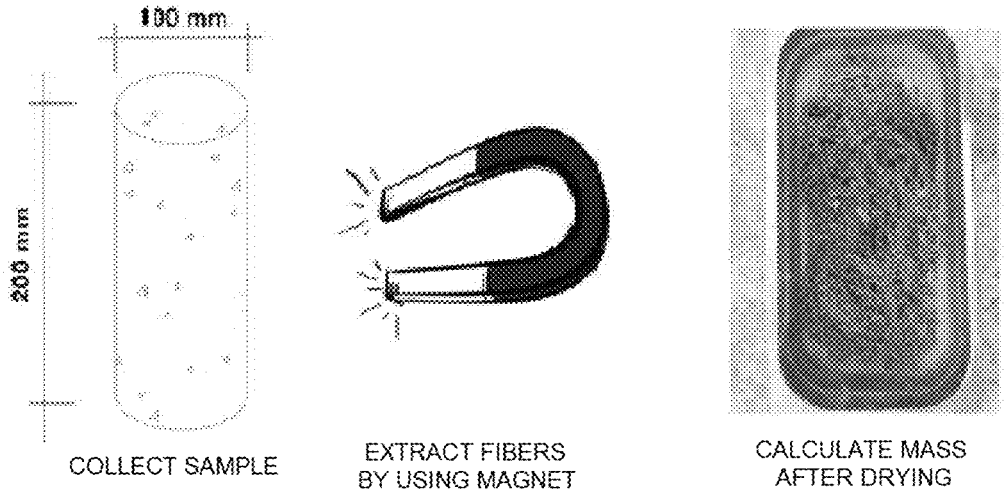
FIG. 17 is a diagram for illustrating a washing test for dispersion evaluation according to the present disclosure.

Since there is no authorized dispersion evaluation test method, a test method was devised in this study. A certain volume (Ø100*200) of concrete, which was completely mixed, was collected, then only steel fiber was picked out by using a magnet, and then a content rate was measured and compared with a target content rate which was aimed during a mixture designing process. FIG. 17 shows an outline of the washing test method for dispersion evaluation.

(4) Compressive Strength and Flexural Toughness

A compressive strength test having an important meaning as basic data for evaluating performance of concrete was measured according to KS F 2405 (a concrete compressive strength test method) by using a cylindrical test sample obtained by collecting a core of Ø100*200 mm.

Figure 18:
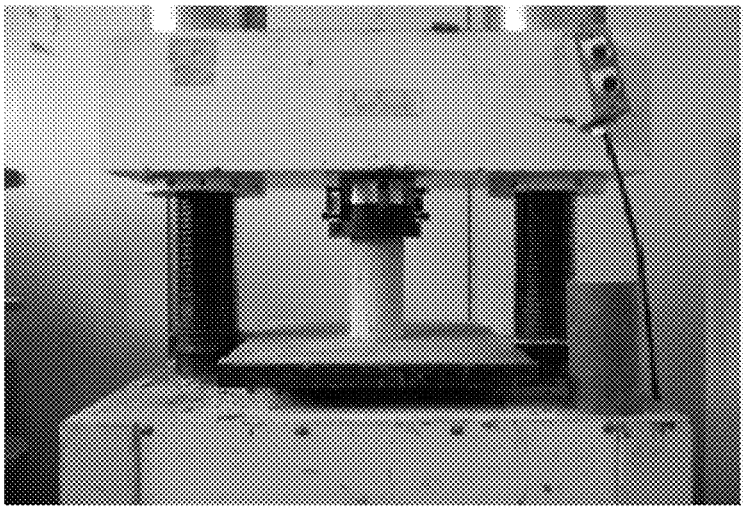
FIG. 18 is a diagram showing a whole view for a compressive strength test according to the present disclosure.

For a concrete flexural toughness test, a prismatic test of 100*100*460 mm is prepared, and three point loads may be vertically applied according to KS F 2566 (a flexural toughness test method of steel fiber-reinforced concrete). The flexural toughness is measured by means of a three point loading method, which may be applied without being inclined. FIG. 18 shows a whole view for the compressive strength test.

(5) Image Analysis Test

Image analysis is an analysis method in which data is extracted quantitatively from any given image in order to extract a size of an object as well as its distribution, brightness, height, area, location, shape or the like. The image analysis is classified into a linear traverse method and a point count method (ASTM C 457).

In the linear traverse method, size, number or the like of pores appearing at the surface of concrete is observed by naked eyes from an enlarged view using a microscope and counted one by one to calculate a necessary coefficient. This method is however substantially not used in these days since it consumes a lot of time for measurement. Based on a hypothesis that all pores distributed in a cubic shape arranged well by means of cement paste have the same diameter, a spacing factor (a distance from a farthest point in the cement paste to a closest pore wall) is equal to a half of a distance between outer circumferences of two pores.

Figure 19:
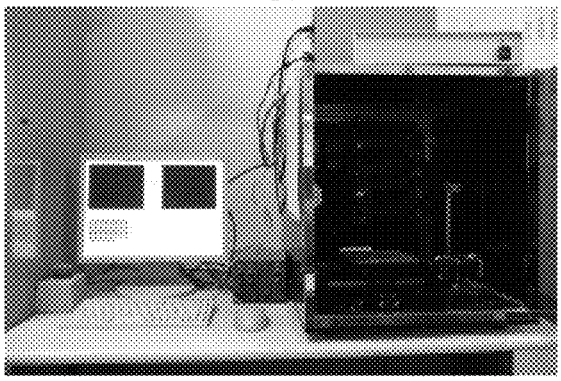
FIG. 19 is a diagram showing an image analysis device according to the present disclosure.

In this study, after hardening, a pore structure of concrete was analyzed using an analysis device HF-MA C01, and as a test for automating the linear traverse method, an analysis method for extracting quantitative data from a given image was used. Here, size, distribution, location or the like of pores is measured to analyze an entire air volume, a spacing factor, a specific surface area, an air volume of each pore size, number of pores of each pore size or the like. This method does not demand professional techniques for its equipment and execution, and if pores are analyzed, an analysis result may be checked instantly. In addition, simple measurement and analysis are ensured by polishing a measurement surface without any special treatment using chemicals or the like. FIG. 19 shows the image analysis device HF-MA-001.

Experiment Results (1) Steel Fiber Dispersion and Content Rate Test Result

Since there is no regulated dispersion test, a fiber agglomeration phenomenon was observed by naked eyes. Here, in a state where an air volume was about 25 to 30% by putting bubbles, a maximum content amount of each fiber was evaluated. 30 mm steel fiber was put in the unit of 0.5% in volume, and it was determined that 30 mm steel fiber could be put as much as up to 3%. 60 mm steel fiber was also in the unit of 0.5% in volume, and it was determined that 60 mm steel fiber could be put as much as up to 1.5%.

Figure 20:
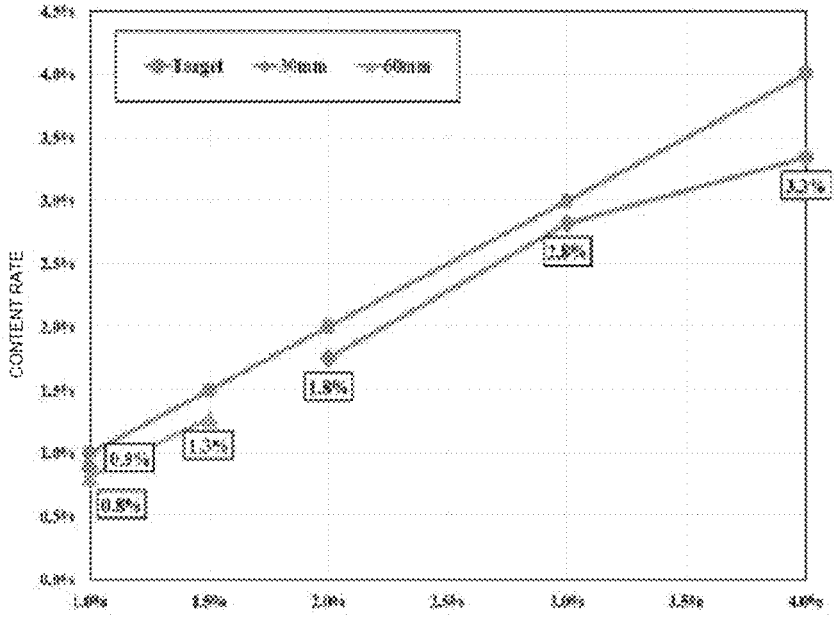
FIG. 20 is a diagram showing an actual content rate of each fiber depending on a target content rate according to the present disclosure.

Since there is no regulated fiber content rate evaluation test method, a washing experiment was devised in this study. Seeing the fiber content rate test result, it was found that 30 mm steel fiber had an actual content rate of 3.3% when a maximum content rate of 4% was put. Also, it was found that 60 mm steel fiber had an actual content rate was 1.3% when a maximum content rate of 1.5% was put. This reveals that an actual fiber content rate is smaller than a target content rate. FIG. 20 is a graph showing an actual content rate according to a target content rate of each fiber.

(2) Air Volume and Slump Test Result

An air volume test was performed by using a unit capacity mass and air volume test for unhardened concrete (a mass method) according to KS F 2409 and a unit quantity measuring method using a unit quantity measurer together, since an air volume of 10% or above is not measured using a pressure method using a general air volume tester. Based on the air volume of 25 to 30% which is determined as an optimal condition for keeping a content rate, a pumping property and workability of fibers before shotcrete was placed, when 30 mm steel fiber was used, the air volume was measured to be 28.1%, and when 60 mm steel fiber was used, the air volume was measured to be 25.5%. After shotcrete was placed, if 30 mm steel fiber was used, the air volume was measured to be 4.1%, and this shows that the air volume was decreased to a suitable level by means of shooting.

Figure 21:
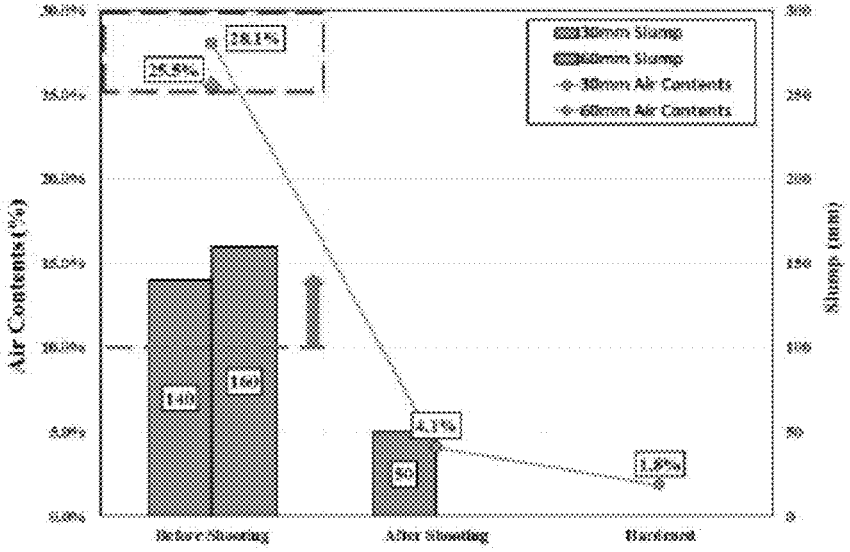
FIG. 21 is a diagram showing change amounts of air volume and slump before and after a shotcrete is placed according to the present disclosure.

In addition, a slump test was performed according to a concrete slump test of KS F 2402. Here, before shotcrete was placed, the slump was 100 mm due to excessively included air volume. Thus, when 30 mm steel fiber was used, the slump was measured to be 140 mm, and when 60 mm steel fiber was used, the slump was measured to be 160 mm. After shotcrete was placed, when 30 mm steel fiber was used, the slump was measured to be 50 mm, which shows that the unit quantity was decreased due to shooting and also the slump was decreased to a suitable level. FIG. 21 shows the changes of an air volume and a slump before and after shotcrete is placed.

(3) Unit Quantity Measurement Results Before and after Shooting

A unit quantity was measured using a unit quantity measurer, three times in total, namely at initial reference mixing, before shotcrete was placed, and after shotcrete was placed. At the reference mixing, the unit quantity was 184.0 $kg/m^3$. However, as bubbles were added, when 30 mm steel fiber was used, the unit quantity was increased to 215.2 $kg/m^3$, and when 60 mm steel fiber was used, the unit quantity was increased to 211.7 $kg/m^3$. However, while shotcrete was being placed, water in the inner materials was dissipated into the air due to an air pressure to decrease the unit quantity, and thus after shooting, it was found that the final unit quantity was changed to 204.0 $kg/m^3$ when 30 mm steel fiber was used.

Figure 22:
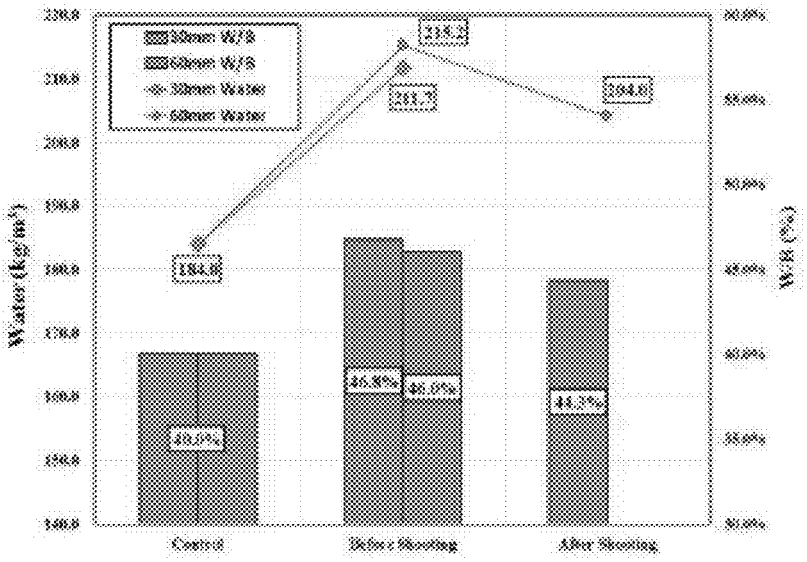
FIG. 22 is a diagram showing a change of unit quantity and a change of W/B before and after a shotcrete is placed according to the present disclosure.

Due to the change of the unit quantity, W/B was also changed. At the initial reference mixing, W/B was designed to be 40.0%, but as bubbles were included, when 30 mm steel fiber was used, the W/B was increased to 46.8%, and when 60 mm steel fiber was used, the W/B was increased to 46.0%. However, while shotcrete was being placed, water in the inner materials was dissipated into the air due to an air pressure to decrease W/B, and thus after shooting, it was found that the final W/B was changed to 44.3% when 30 mm steel fiber was used. FIG. 22 shows the changes of a unit quantity and W/B before and after shotcrete is placed.

(4) Compressive Strength and Bending Strength Test Result

Figure 23:
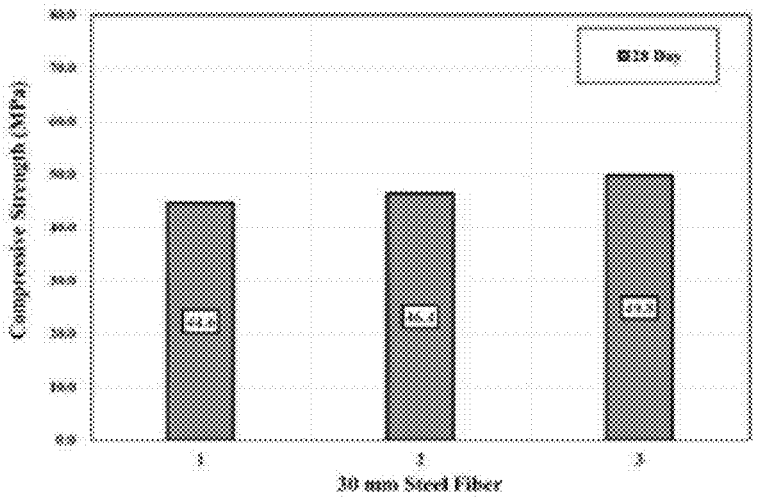
FIGS. 23 and 24 are diagrams showing test results of a compressive strength and a bending strength of the fiber-reinforced concrete according to the present disclosure.

A compressive strength test and a bending strength test were respectively performed according to KS F 2405 and KS F 2408. Here, the compressive strength was tested after being aged for 28 days and 56 days, and the bending strength was tested after being aged for 28 days. A compressive strength aged for 28 days was measured to be 46.9 MPa on average, which satisfied the target strength of 40 MPa. FIG. 23 shows a compressive strength test result after being aged for 28 days.

Figure 24:
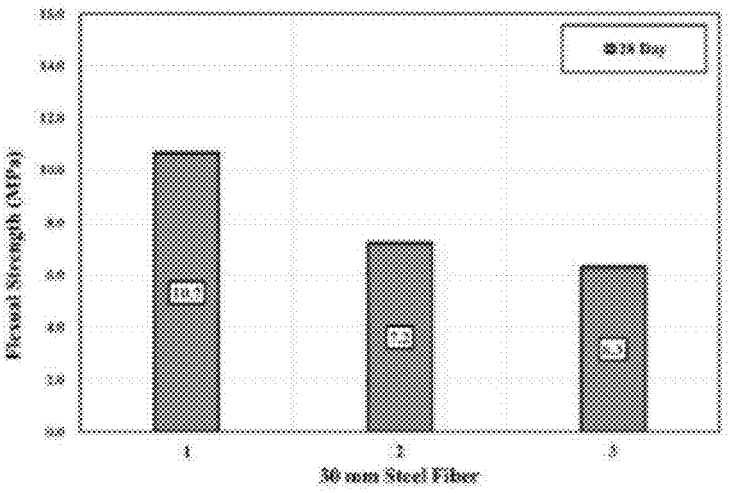

In addition, a bending strength aged for 28 days after shooting was exhibited to be 8.1 MPa on average. FIG. 24 shows a bending strength test result after being aged for 28 days.

(5) Flexural Toughness Test Result (28 Days)

Figure 25:
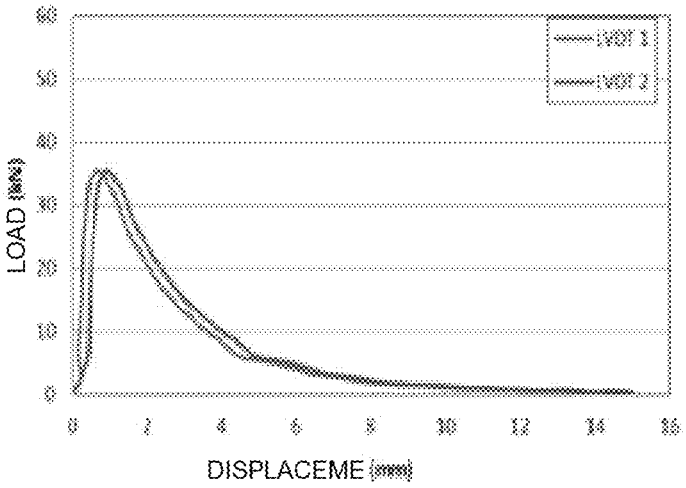
FIGS. 25 to 27 are diagrams showing a load displacement curve of each test sample as a result of flexural toughness test for the fiber-reinforced concrete according to the present disclosure.
Figure 26:
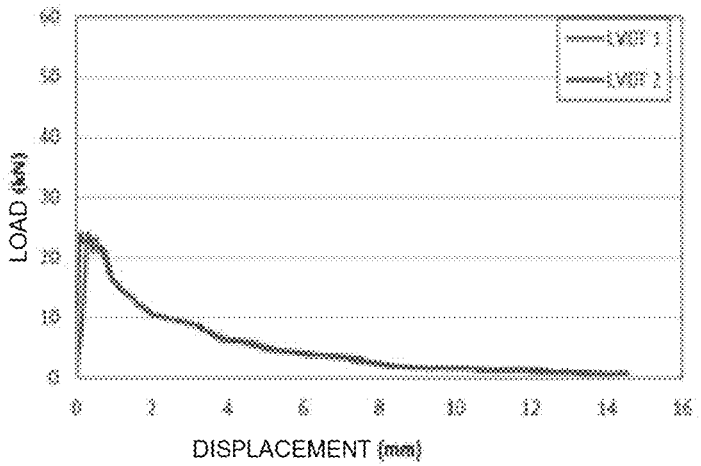
Figure 27:
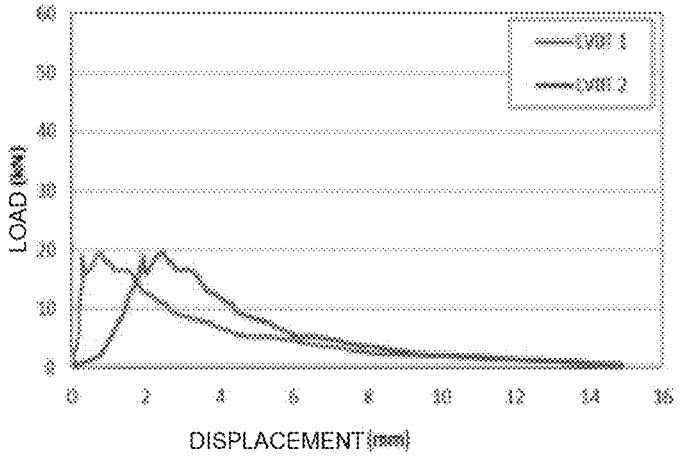

A flexural toughness test was performed according to KS F 2566 and measured after being aged for 28 days. As a result of the flexural toughness measurement, an index 15 was measured to be in the range of 3.85 to 5.87, which satisfied a target value of $l_5>5$. Table 5 shows a flexural toughness index, and FIGS. 25 to 27 are graphs showing a load displacement curve of each sample according to the flexural toughness test result test.

TABLE 5

| | 1 | 2 | 3 |
|---|---|---|---|
| $l_5$ | 5.87 | 5.76 | 3.85 |

(6) Image Analysis Test Result (28 Days)

An image analysis test is performed according to ASTM C 457 to measure size, distribution, location or the like of pores at a hardened concrete sample in order to analyze an entire air volume, a spacing factor, a specific surface area, an air volume of each pore size, number of pores of each pore size or the like.

In order to check an image analysis result of a fiber-reinforced concrete including bubbles, an image analysis was performed to a test sample aged for 28 days. In order to check whether an air volume was appropriately maintained after bubble dissipation after shooting, the shot panel was cored and tested after shotcrete was placed.

Figure 28:
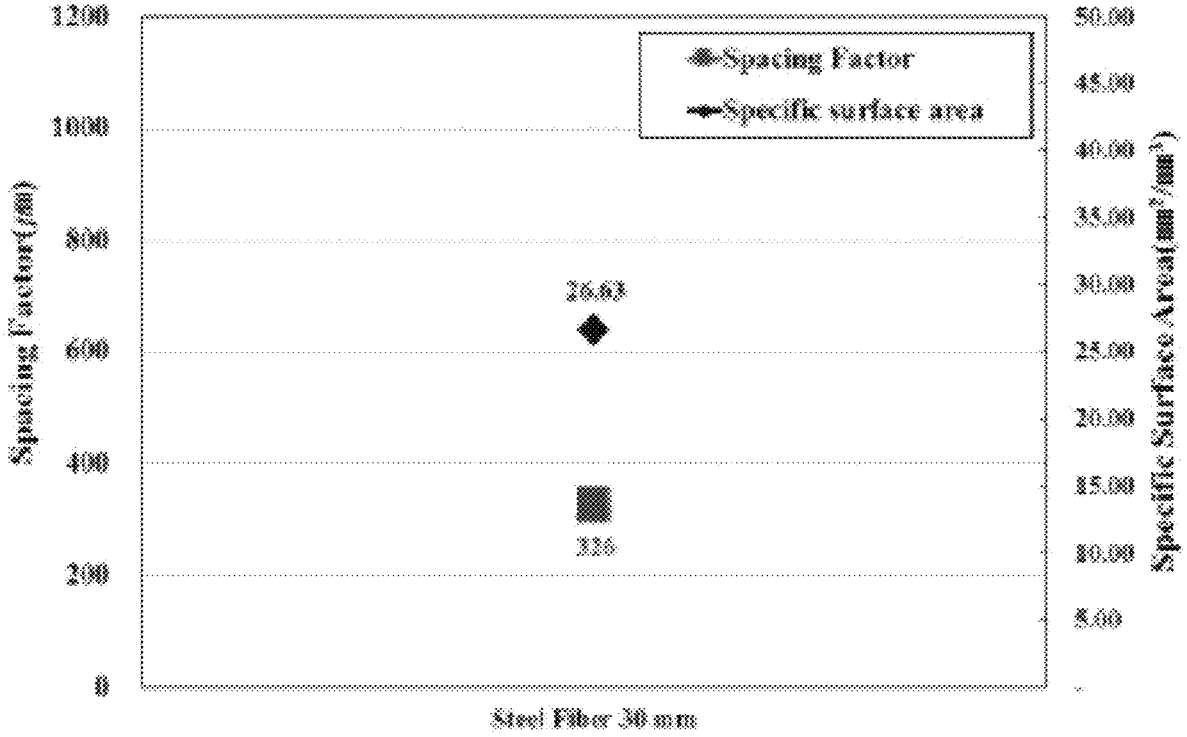
FIG. 28 is a diagram showing a specific surface area and a spacing factor measured by an image analysis test according to the present disclosure.

In the test result, the specific surface area was measured to be 26.63 μm, and the spacing factor was measured to be 326 $mm^2/mm^3$. This value however does not satisfy the spacing factor of 250 $mm^2/mm^3$ proposed in Kansas DOT and the spacing factor of 200 $mm^2/mm^3$ proposed in a Mindess document. FIG. 28 is a graph showing a specific surface area and a spacing factor measured through the image analysis test.

(7) Fiber Tensile Strength Test Result

A fiber tensile strength test was performed according to KS F 2565 by a specialized quality test agent of a company H. Here, at the fiber tensile strength test result for 60 mm steel fiber and 30 mm steel fiber, 60 mm steel fiber was measured to have a fiber tensile strength of 1200.3 MPa, and 30 mm steel fiber was measured to have a fiber tensile strength 1020.2 MPa, both of which did not satisfy a target fiber tensile strength of 1200 MPa. Table 6 shows a quality test result of each fiber.

TABLE 6

| Serial No. | Test/check item | Test/check method | Test/check result |
|---|---|---|---|
| 1 | steel fiber tensile strength (60 mm) | KS F 2565 | diameter: 0.75 (mm) average: 1200.3 (MPa) |
| 2 | steel fiber tensile strength (30 mm) | | diameter: 0.5 (mm) average: 1020.2 (MPa) |

Through the above tests, the performance of the fiber-reinforced concrete was verified by means of a physical characteristic and durability test, and as bubbles are included in the proposed shotcrete materials, the fiber is dispersed without a fiber ball phenomenon. Also, excellent pumping performance allowing smooth conveyance through a hose is demanded, and after shotcrete is hardened, high strength and high tension are ensured.

Therefore, in the dispersion and content rate test result, it may be found that optimal dispersion is exhibited to ensure uniform dispersion of the steel fiber when bubbles are included by the content of about 25 to 30%. Also, in the air volume and slump test result, bubbles excessively added before shooting are dissipated by means of shooting, and thus after shooting, the air volume may be maintained appropriated. In addition, water put before shooting is somewhat dissipated, which ensures an excellent unit quantity dissipation effect.

In addition, in the compressive strength and being strength test result, the material sufficiently meets the performance with a high strength over a target strength of 40 MPa. Also, in the flexural toughness test result, the index 15 was measured to be in the range of 3.85 to 5.87, which satisfies a target value of 15>5.

In the present disclosure, the embodiment is just an example, and the present disclosure is not limited thereto. Any feature whose construction and effect are identical to those defined in the claims of the present disclosure should be regarded as falling within the scope of the present disclosure.

The invention claimed is:

1. An apparatus for manufacturing a fiber-reinforced concrete through shooting after inserting bubbles into a normal concrete, the apparatus comprising:

a fiber-mixed concrete forming unit configured to form a fiber-mixed concrete by mixing bubbles, fiber-mixed material and silica fume into a normal concrete prepared by mixing water, cement, and aggregates at a predetermined ratio or by putting and mixing aggregates, water and bubbles into a mixture in which cement, fiber-mixed material and silica fume are mixed;

a concrete shooting unit configured to shoot a fiber-reinforced concrete whose slump is decreased to a slump range of the normal concrete, while dissipating bubbles included in the fiber-mixed concrete by blowing a high-pressure air of 5 atmospheres or above, when the fiber-mixed concrete mixed at the fiber-mixed concrete forming unit is discharged, wherein the concrete shooting unit comprising a shooting guide member detachably mounted to the fiber-mixed concrete forming unit to compress and discharge a fiber-mixed concrete; and an air supply hole formed through an outer circumference of the shooting guide member to dissipate bubbles included in the fiber-mixed concrete and reduce an air volume by means of a high-pressure air of 5 atmospheres or above supplied therethrough, wherein the air supply hole is formed with a slope in a radial direction at the outer circumference of the shooting guide member, wherein the fiber-mixed concrete forming unit comprising:

an external body that accommodates the normal concrete together with the bubbles, the fiber-mixed material and the silica fume;

a shaft formed in the external body to rotate by a motor; and a mixing member formed at the shaft to have at least one stage in a radial direction to mix the normal concrete with the bubbles, the fiber-mixed material and the silica fume.

2. The apparatus for manufacturing a fiber-reinforced concrete through shooting after inserting bubbles into a normal concrete of claim 1, wherein the fiber-mixed material is at least one selected from the group consisting of steel fiber, glass fiber, carbon fiber, basalt fiber, aramid fiber, polyethylene fiber, polyvinyl fiber, nylon fiber, cellulous fiber, and mixtures thereof.

3. The apparatus for manufacturing a fiber-reinforced concrete through shooting after inserting bubbles into a normal concrete of claim 2, wherein the steel fiber, the glass fiber, the carbon fiber and the basalt fiber are mixed by the content of 5 parts by weight, based on 100 parts by weight of cement of the normal concrete.

4. The apparatus for manufacturing a fiber-reinforced concrete through shooting after inserting bubbles into a normal concrete of claim 2, wherein the aramid fiber, the polyethylene fiber, the polyvinyl fiber, the nylon fiber and the cellulous fiber are mixed by the content of 3 parts by weight, based on 100 parts by weight of cement of the normal concrete.

5. The apparatus for manufacturing a fiber-reinforced concrete through shooting after inserting bubbles into a normal concrete of claim 1, wherein the silica fume is mixed by the content of 5 to 10 parts by weight, based on 100 parts by weight of cement of the normal concrete.

6. The apparatus for manufacturing a fiber-reinforced concrete through shooting after inserting bubbles into a normal concrete of claim 1, wherein the fiber-mixed concrete forming unit includes:

an external body configured to accommodate the normal concrete together with the bubbles, the fiber-mixed material and the silica fume;

a shaft formed in the external body to rotate by means of a power of a motor; and a mixing member formed at the shaft to have at least one stage in a radial direction to mix the normal concrete with the bubbles, the fiber-mixed material and the silica fume, thereby forming a fiber-mixed concrete.

7. The apparatus for manufacturing a fiber-reinforced concrete through shooting after inserting bubbles into a normal concrete of claim 6, wherein the external body is a concrete mixer truck.

8. The apparatus for manufacturing a fiber-reinforced concrete through shooting after inserting bubbles into a normal concrete of claim 1, wherein the fiber-mixed concrete forming unit includes:

a hopper configured to receive the normal concrete;

a shaft configured to rotate by a power of a motor provided at a lower end of the hopper; and a mixing member mounted to the shaft to mix the normal concrete with the bubbles, the fiber-mixed material and the silica fume, thereby forming a fiber-mixed concrete.

9. The apparatus for manufacturing a fiber-reinforced concrete through shooting after inserting bubbles into a normal concrete of claim 6, wherein the fiber-mixed material is at least one selected from the group consisting of steel fiber, glass fiber, carbon fiber, basalt fiber, aramid fiber, polyethylene fiber, polyvinyl fiber, nylon fiber, cellulous fiber, and mixtures thereof.

10. The apparatus for manufacturing a fiber-reinforced concrete through shooting after inserting bubbles into a normal concrete of claim 9, wherein the steel fiber, the glass fiber, the carbon fiber and the basalt fiber are mixed by the content of 5 parts by weight, based on 100 parts by weight of cement of the normal concrete.

11. The apparatus for manufacturing a fiber-reinforced concrete through shooting after inserting bubbles into a normal concrete of claim 9, wherein the aramid fiber, the polyethylene fiber, the polyvinyl fiber, the nylon fiber and the cellulous fiber are mixed by the content of 3 parts by weight, based on 100 parts by weight of cement of the normal concrete.

12. The apparatus for manufacturing a fiber-reinforced concrete through shooting after inserting bubbles into a normal concrete of claim 6, wherein the silica fume is mixed by the content of 5 to 10 parts by weight, based on 100 parts by weight of cement of the normal concrete.

13. The apparatus for manufacturing a fiber-reinforced concrete through shooting after inserting bubbles into a normal concrete of claim 8, wherein the fiber-mixed material is at least one selected from the group consisting of steel fiber, glass fiber, carbon fiber, basalt fiber, aramid fiber, polyethylene fiber, polyvinyl fiber, nylon fiber, cellulous fiber, and mixtures thereof.

14. The apparatus for manufacturing a fiber-reinforced concrete through shooting after inserting bubbles into a normal concrete of claim 13, wherein the steel fiber, the glass fiber, the carbon fiber and the basalt fiber are mixed by the content of 5 parts by weight, based on 100 parts by weight of cement of the normal concrete.

15. The apparatus for manufacturing a fiber-reinforced concrete through shooting after inserting bubbles into a normal concrete of claim 13, wherein the aramid fiber, the polyethylene fiber, the polyvinyl fiber, the nylon fiber and the cellulous fiber are mixed by the content of 3 parts by weight, based on 100 parts by weight of cement of the normal concrete.

16. The apparatus for manufacturing a fiber-reinforced concrete through shooting after inserting bubbles into a normal concrete of claim 8, wherein the silica fume is mixed by the content of 5 to 10 parts by weight, based on 100 parts by weight of cement of the normal concrete.

17. The apparatus for manufacturing a fiber-reinforced concrete through shooting after inserting bubbles into a normal concrete of claim 1, wherein the fiber-mixed material is at least one selected from the group consisting of steel fiber, glass fiber, carbon fiber, basalt fiber, aramid fiber, polyethylene fiber, polyvinyl fiber, nylon fiber, cellulous fiber, and mixtures thereof.

18. The apparatus for manufacturing a fiber-reinforced concrete through shooting after inserting bubbles into a normal concrete of claim 17, wherein the steel fiber, the glass fiber, the carbon fiber and the basalt fiber are mixed by the content of 5 parts by weight, based on 100 parts by weight of cement of the normal concrete.

* * * * *